US005862759A

United States Patent [19]

Mauli et al.

[11] Patent Number: 5,862,759

[45] Date of Patent: Jan. 26, 1999

[54] SELF-PROPELLED MACHINE FOR STABILIZING, BY HAMMERING AND COMPACTING, TRACKS LAID ON BALLAST

[76] Inventors: Enzo Mauli, Contrada Polese, 55, 37136 Verona; Cesare Rossanigo, Cascina Rossanigo, 16, 15042 Bassignana (Prov. of Alessandria), both of Italy

[21] Appl. No.: 787,065

[22] Filed: Jan. 22, 1997

[30] Foreign Application Priority Data

Jan. 25, 1996 [IT] Italy ..... TO96A0041

[51] Int. Cl.[6] ..... E01B 27/00

[52] U.S. Cl. ..... 104/12

[58] Field of Search ..... 104/10, 12, 2

[56] References Cited

U.S. PATENT DOCUMENTS

| | | | |
|---|---|---|---|
| 3,589,298 | 6/1971 | Plasser | 104/12 |
| 3,735,708 | 5/1973 | Plasser et al. | 104/12 |
| 3,795,198 | 3/1974 | Plasser et al. | 104/12 |
| 3,913,490 | 10/1975 | Theurer et al. | 104/12 |
| 4,043,271 | 8/1977 | Theurer et al. | 104/12 |
| 4,111,129 | 9/1978 | Von Beckmann | 104/12 |
| 4,125,075 | 11/1978 | Stewart | 104/12 |
| 4,489,658 | 12/1984 | Von Beckmann . | |
| 4,628,822 | 12/1986 | Theurer | 104/12 |
| 4,899,664 | 2/1990 | Moore et al. | 104/12 |
| 5,007,350 | 4/1991 | Theurer | 104/12 |

FOREIGN PATENT DOCUMENTS

| | | | |
|---|---|---|---|
| 0539347 | 4/1993 | European Pat. Off. . | |
| 2155420 | 5/1973 | France . | |
| 2302383 | 9/1976 | France . | |
| 2008174 | 9/1971 | Germany | 104/12 |
| 2114282 | 10/1971 | Germany . | |
| 1659562 | 6/1991 | Russian Federation | 104/12 |
| 2006542 | 1/1994 | Russian Federation | 104/12 |

*Primary Examiner*—Mark Tuan Le
*Attorney, Agent, or Firm*—Guido Modiano; Albert Josif

[57] ABSTRACT

The machine is constituted by a self-propelled truck which comprises a first hammering unit and a second compacting unit. The first unit comprises mutually opposite sets of inclined vibrating hydraulic tools which can be arranged so as to straddle each tie and are adapted to limit the migration of crushed rock from the tamping regions of the ballast, which lie below each tie, to the intermediate ballast regions which lie between two consecutive ties. The second unit is constituted by vibrating plates, which are also actuated hydraulically and are adapted to compact the crushed rock located in the layer above the laying plane of the ties in the intermediate ballast regions and on the heads of the ties. The first and second units are supported by a portal-shaped chassis of the car , are mutually spaced by an extent which is a multiple of the various spacing pitches of the ties of the track, and are arranged so that during working travel of the car the first unit precedes the second unit.

23 Claims, 8 Drawing Sheets

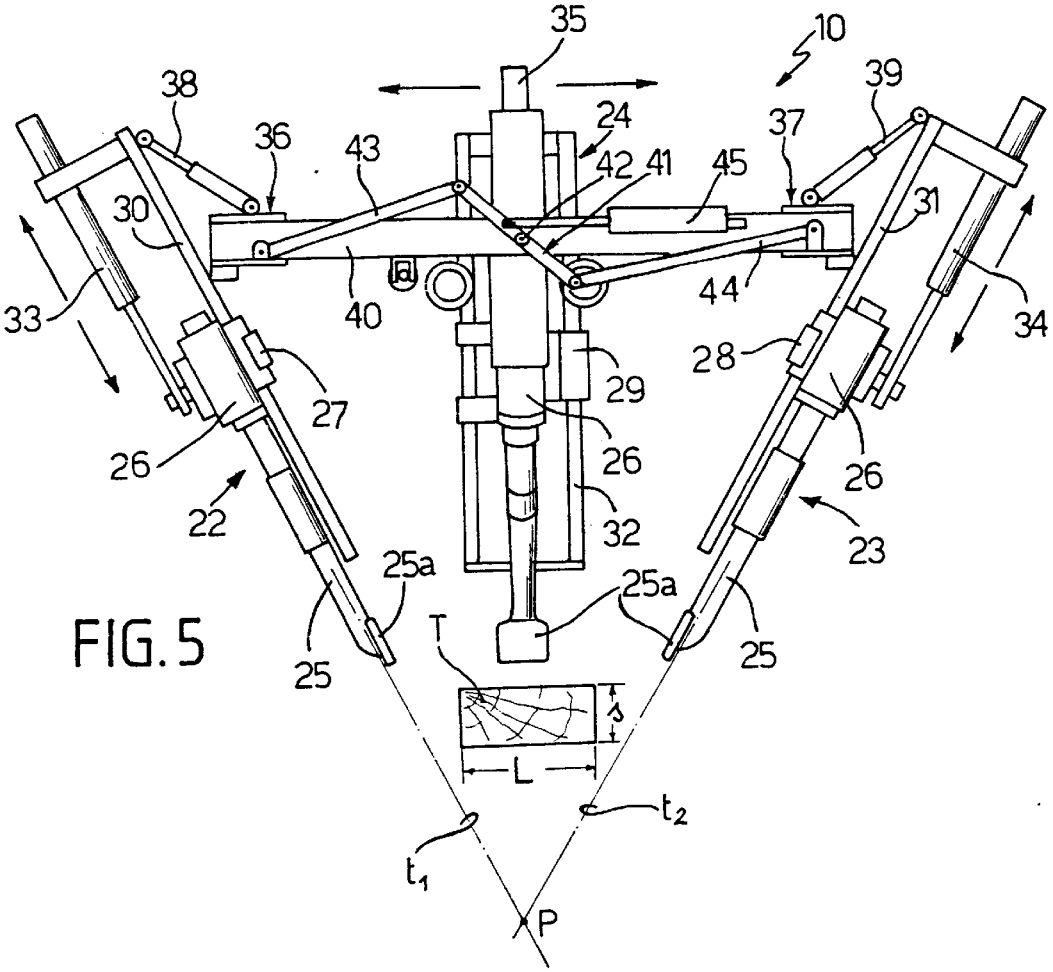
FIG. 5
FIG. 6
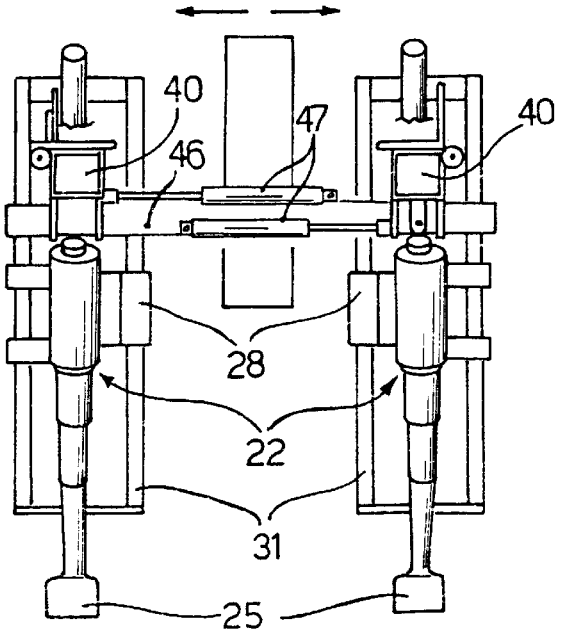

SELF-PROPELLED MACHINE FOR STABILIZING, BY HAMMERING AND COMPACTING, TRACKS LAID ON BALLAST

BACKGROUND OF THE INVENTION

The present invention relates to a self-propelled machine for stabilizing tracks laid on ballast.

After repairs to the geometry of tracks, usually performed by means of tamping, aligning, and leveling machines, ballast settling conventionally occurs when the first trains pass; this settling is characterized by the migration of the crushed rock from the tamping region below each tie towards the upper part of the ballast in the intermediate region and towards the heads which lie externally with respect to said ties.

The enclosed FIGS. 1 and 1*a* schematically show said settling of the crushed rock which, due to the passage of the trains C on the track BI, migrates partially from the tamping region A below the ties $T_1$, $T_2$ . . . , $T_n$ in the upper part of the region B of the ballast which lies between two consecutive ties $T_1$–$T_2$, and simultaneously, due to the hunting of the trains, towards the head regions C (FIG. 1*a*).

This settling produced by the migration of the crushed rock in the specified direction is followed by a variation in the level of the track in the longitudinal plane (change in the elevation of the rolling plane) and by a deflection of said track in the transverse plane or plane of arrangement (lateral deflection and/or misalignment), with a consequent alteration of the geometric characteristics of the track which is not compatible with the travel comfort and is correlated to the transit speed of modern trains.

The operations for restoring and regenerating railroad ballasts must therefore be followed by one or more track stabilizing operations aimed at preventing the uncontrolled settling of the regenerated ballast produced by the passage of trains.

Track stabilizing machines already exist for this purpose which act by vibration on said track but have several disadvantages, the main one being the generation of intense stresses on the systems for coupling the rail and the tie to each other and the more or less extensive modification of the track laying geometry. Moreover, these conventional machines are necessarily limited in their use, since the intensity of the shaking vibrations transmitted by said machines to the track causes stability problems for the static structures lying adjacent to the railroad, particularly to buildings, bridges, overpasses, underpasses, level crossings, and to the moving elements of tracks such as switches, junctions, and the like, so that said conventional machines are unable to perform adequate work over entire stretches of the railroad.

SUMMARY OF THE INVENTION

A principal aim of the present invention is substantially to eliminate these and other drawbacks of conventional stabilization systems, and within the scope of this general aim said invention has the important object of providing a self-propelled machine which is capable of performing track stabilization by acting only on the ballast, therefore maintaining the laying geometry of the rail on the one hand and eliminating undesirable stresses on the rail-tie connecting systems on the other hand.

The invention also has the purpose of providing a self-propelled stabilizing machine which can be used on any stretch of railroad and even close to buildings and structures adjacent to the railroad path.

Another important object of the invention is to provide a track stabilizing machine which is reliable in operation, structurally simple, and capable of acting even in the presence of switches, track junctions, level crossings, etcetera.

According to the invention, this aim and other important functional objects are achieved with a machine having the specific characteristics described in the appended claims.

Substantially, the invention is based on the concept of using a self-propelled car which has a first hammering unit formed by pairs of vibrating hydraulic tools which are supported by a portal-shaped framework of the car and can be arranged so as to straddle each tie and at the heads of said ties.

Said vibrating tools of the hammering unit are slidingly supported on corresponding inclined guides and by virtue of the action of movement jacks they move along respective subvertical advancement paths which intersect in an imaginary point which lies below the involved tie, in the above-mentioned tamping region A, with this subvertical arrangement, the hydraulic tools of the hammering unit produce, by means of their vibration, on the one hand the compaction of the crushed rock in the tamping region below the tie and, on the other hand, the migration of the excess crushed rock in the region B which lies between two consecutive ties, said region being the one which has the lowest crushed-rock density.

In this manner, in said intermediate regions the crushed rock rises beyond the plane of arrangement of the ties and is subjected to subsequent compaction by means of a second compaction unit formed by vibrating plates, which are also supported by the portal-shaped framework of the self-propelled car.

The hammering tools and the compaction plates can be spaced from each other by an extent which is a multiple of the spacing pitch of the ties installed in the specific stretch of track being treated, and the plates come after the tools with reference to the advancement motion of the car, so as to be able to compact the crushed rock lifted by the preceding action of the hammering tools.

BRIEF DESCRIPTION OF THE DRAWINGS

Further characteristics and advantages of the stabilizing machine according to the invention will become apparent from the following detailed description and with reference to the accompanying drawings, given by way of non-limitative example and wherein:

FIG. 5 is a detail lateral elevation view of the first unit of FIG. 4;

FIG. 6 is an enlarged-scale partial front sectional view, taken along the plane VI—VI of FIG. 3;

DESCRIPTION OF THE PREFERRED EMBODIMENTS

With reference to FIGS. 2 to 10, the machine according to the invention is constituted by a self-propelled car 10, provided with pairs of wheels 11–12, at least one of said pairs being a driving pair, and with a powerplant 13 which provides the power required both for the movement of the car 10 and for the actuation of one or more hydraulic pumps 14 which supply the various fluid-actuated actuators described hereinafter.

Figure 2:
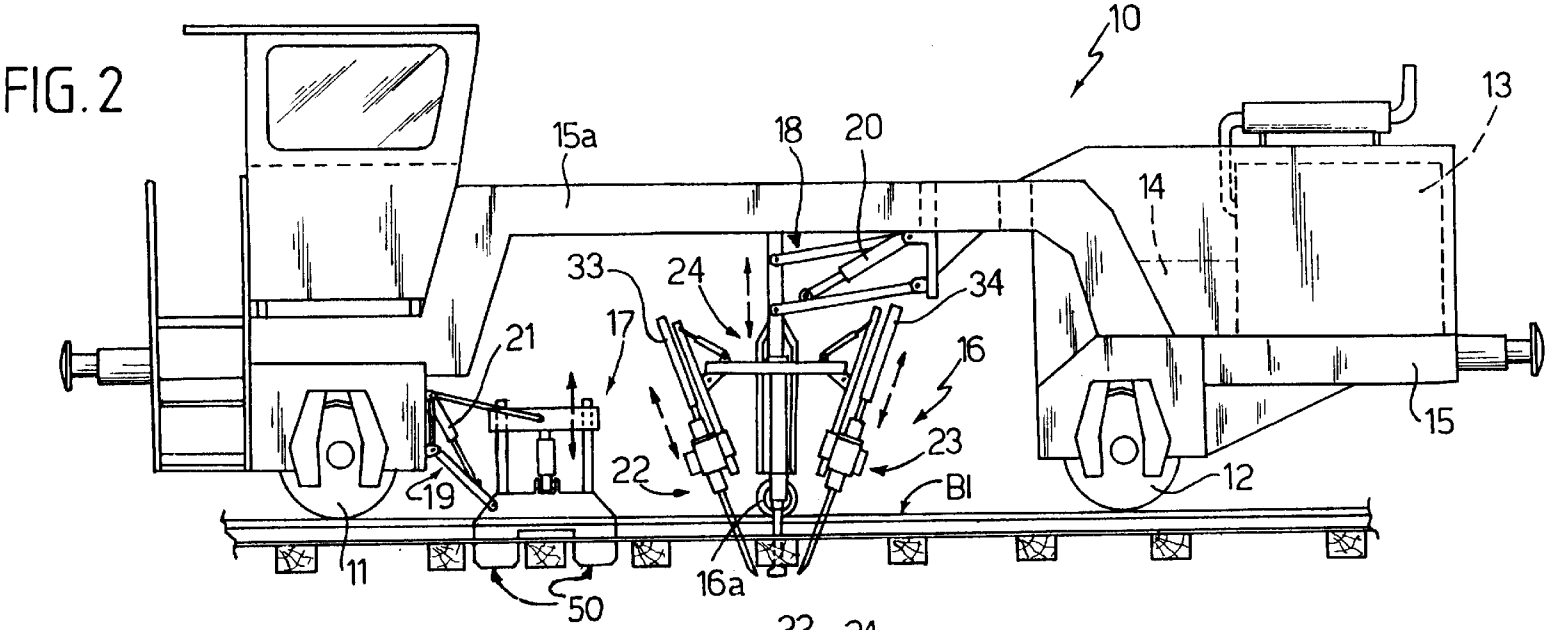
FIG. 2 is a schematic elevation view of the stabilizing and compacting machine according to the invention.
Figure 3:
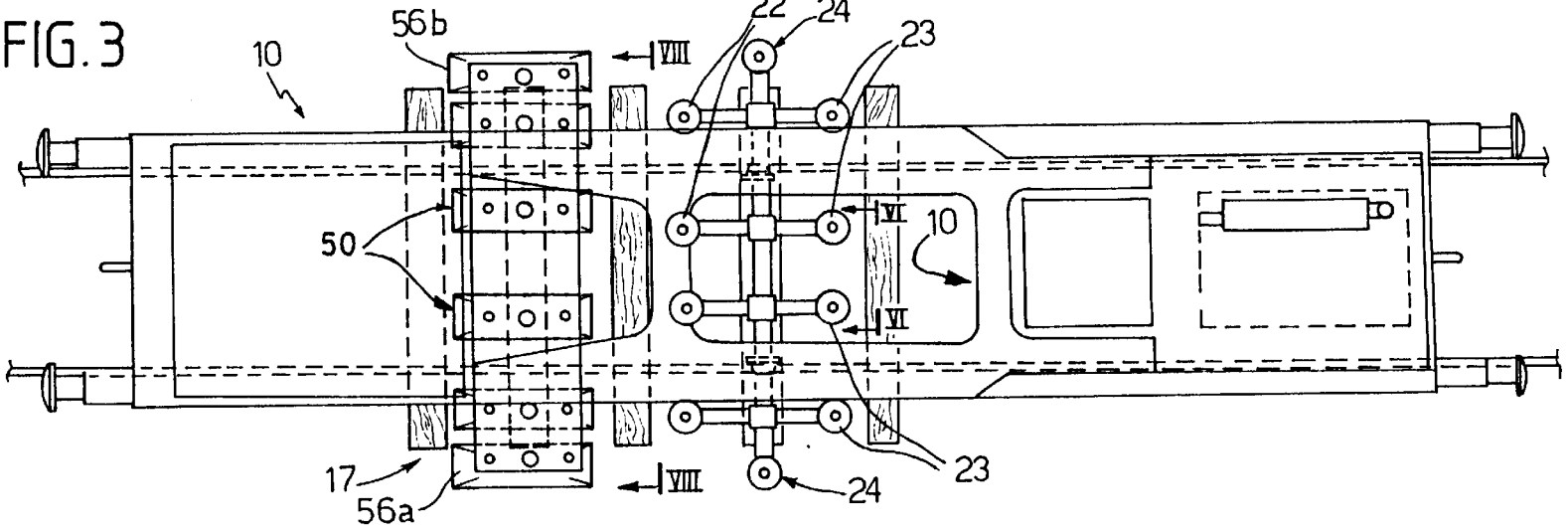
FIG. 3 is a top plan view of FIG. 2.

The self-propelled car 10 has a chassis 15 with a central portal-shaped raised portion 15*a* which supports a first hammering unit, shown schematically in FIG. 2 and generally designated by the reference numeral 16, and a second compacting unit, also shown schematically in FIG. 2 and generally designated by the reference numeral 17.

Both units 16 and 17 are supported by the chassis 15 with the interposition of respective vertical movement devices. In particular, the unit 16 is supported with the interposition of a respective articulated frame 18 provided with at least one movement jack 20, in order to arrange it in a raised position (not shown) during the travel of the car 10, or in a lowered operating position (FIG. 2) in which said unit rests, with two of its own supporting wheels 16*a*, on the track BI. Likewise, the unit 17 is supported by an articulated structure which is subjected to a vertical movement jack 21 for the same purposes.

Figure 4:
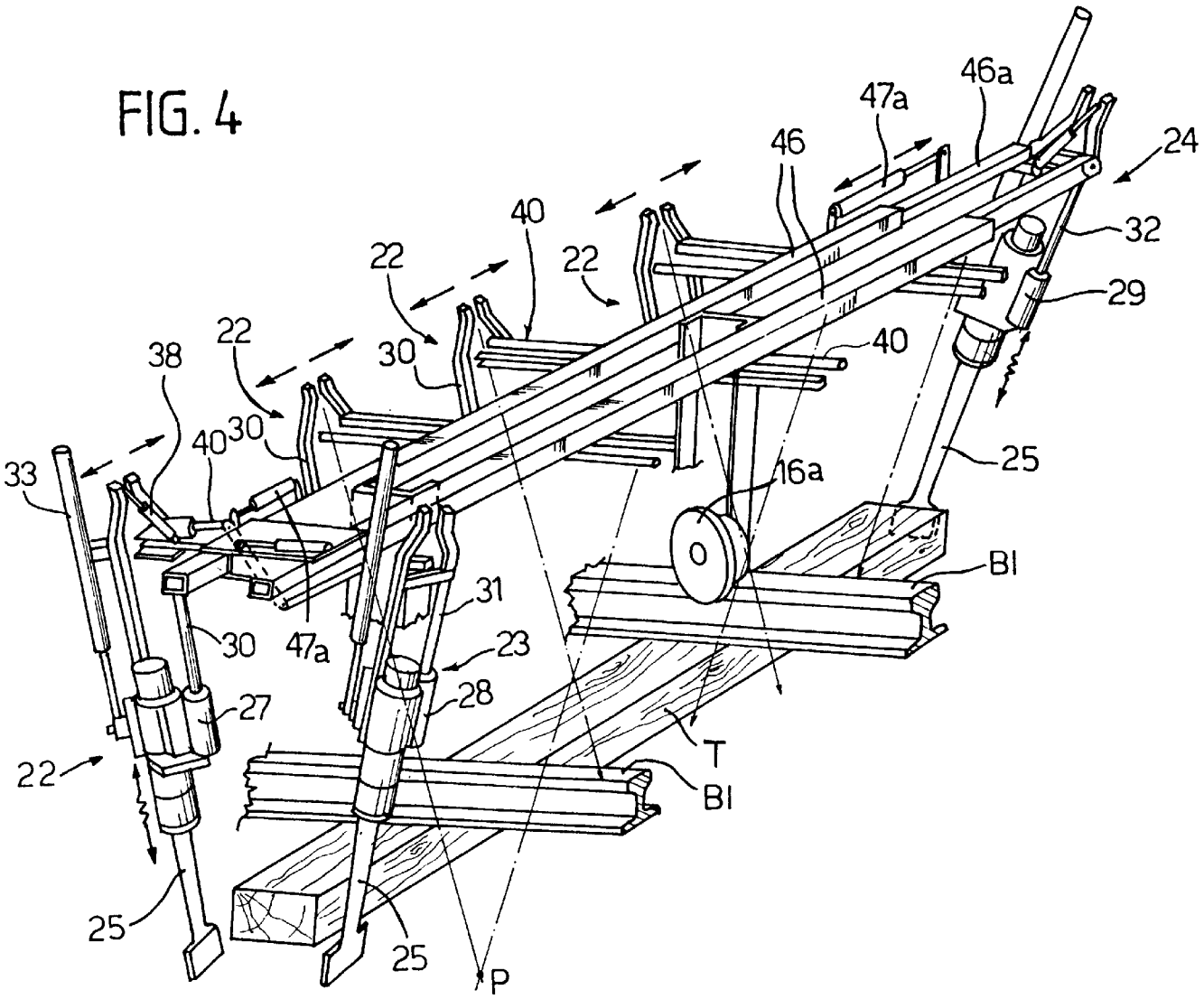
FIG. 4 is a schematic partial perspective view of the hammering unit.
Figure 9:
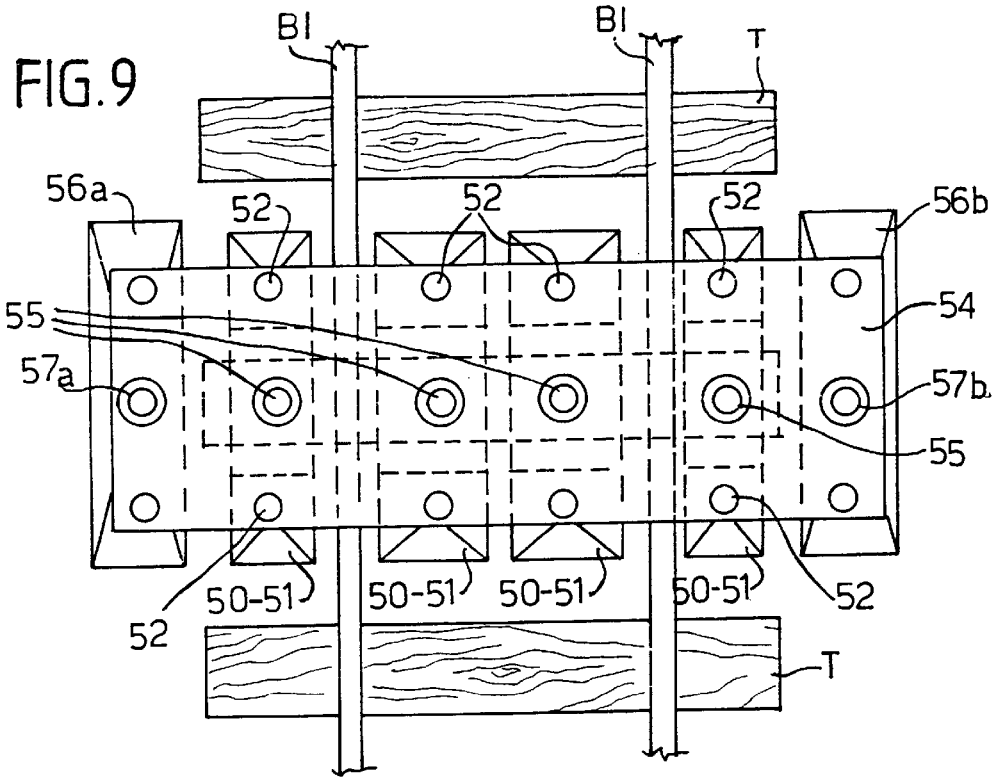
FIG. 9 is a plan view of the compaction unit, taken in the direction of the arrows IX—IX of FIG. 8.
Figure 8:
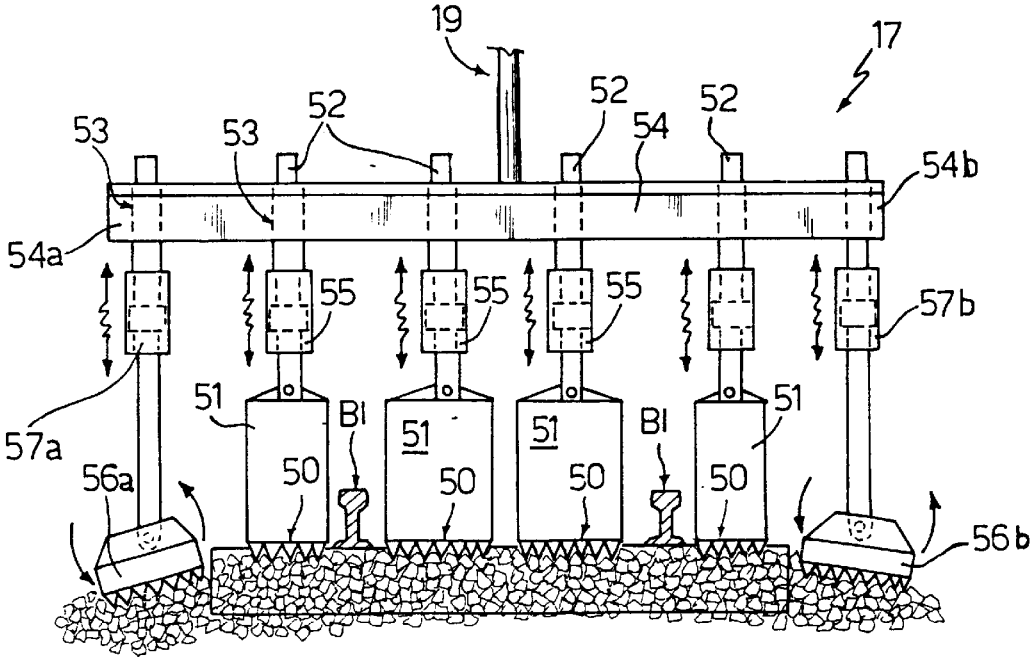
FIG. 8 is an enlarged-scale front elevation view of a detail of the second compacting unit.

With reference to FIGS. 4, 5, and 6, it is noted that the hammering unit 16 is formed by mutually opposite sets of vibrating hydraulic tools 22, 23, and 24; the first two are formed, for example, by four tools each and are aligned transversely with respect to the track BI, and the third one is formed by two mutually opposite tools located at the head of each tie T. Each tool comprises a hammer 25 which has an end plate 25*a* and is moved in a reciprocating fashion by a corresponding double-action hydraulic jack 26 at a rate and with a stroke which can be adjusted by the operator or by programmable electronic control means. The hydraulic jacks 26 are powered by a hydraulic circuit (not shown) by means of electric distribution valves of the two-way type, the solenoids whereof are energized in a cyclic fashion by a variable-frequency oscillator or, as an alternative, by a rotary mechanical distributor which is driven by an adjustable-speed electric motor according to supply circuit arrangements which are both known and are disclosed in prior Italian patent no. 1,219,091 in the name of SO.RE.MA S.r.l. The hydraulic tools 22, which face each other transversely to the track, are arranged mutually opposite with respect to the hydraulic tools 23, which also face each other transversely to the track, so as to form mutually opposite pairs of tools 22 and 23, which are arranged so as to straddle each tie T during work.

Figure 1:
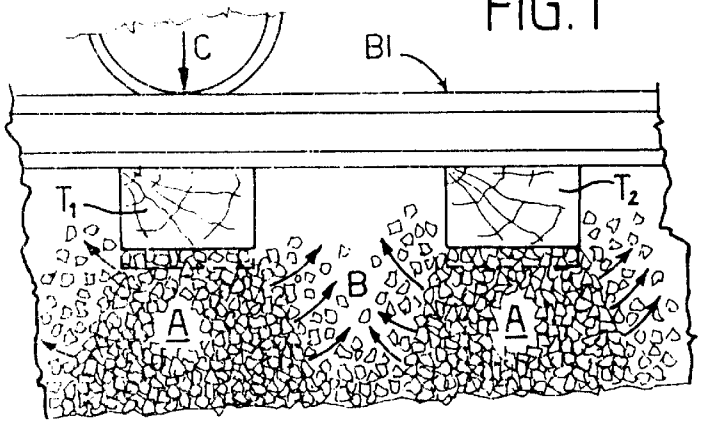

As clearly shown in the figures, the individual vibrating hydraulic tools 22, 23, and 24 are supported by respective sliders 27, 28, and 29 which can slide on corresponding supporting guides 30, 31, and 32 and are controlled by corresponding movement jacks 33, 34, and 35, which are capable of making the corresponding tool perform an advancement stroke, which sinks the vibrating hammer 25 into the crushed rock of the ballast, and a stroke for extracting said hammer from the crushed rock. Each tool can also be individually raised to temporarily exclude it from the operating cycle, for example at switches, level crossings, and the like. The guides 30 and 31 of the pairs of mutually opposite tools 22 and 23 are inclined in opposite directions with respect to the vertical, so that the advancement paths t1–t2 of said pairs of tools converge and intersect in an imaginary point P which lies below the tie T whereon the unit 16 acts in the tamping region A shown in FIG. 1.

Likewise, the guides 32 of the pair of head tools 24 have mutually opposite inclinations, so that the advancement paths of the respective tools also meet in a point which lies below the ties but does not necessarily coincide with the point P.

The inclination of the guides 30, 31, and 32 can vary in order to adapt the hammering unit 16 to ties T having a different thickness s. Likewise, the distance (in a longitudinal direction) between the guides 30 and 31 of at least the mutually opposite pairs of transverse tools 22 and 23 can be varied in order to adapt the unit 16 to ties T having a different width L.

For these purposes, the guides 30 and 31 are articulated to respective sleeves 36 and 37 by means of pivots and are actuated by hydraulic jacks 38 and 39 which allow to rotate the respective guide about its own pivoting point and to rigidly couple it with the desired inclination. In order to allow to vary the distance between the mutually opposite pairs of guides 30 and 31, the respective pivoting sleeves 36 and 37 are slidingly supported on corresponding longitudinal connecting beams 40, and each pair of mutually opposite sleeves 36 and 37 is controlled by a kinematic movement system which moves them mutually closer or further apart, making them slide simultaneously in opposite directions on the corresponding connecting beam 40, which also acts as a guide for said pair of sleeves.

According to a preferred embodiment, the kinematic system comprises a central rod 41 which can rotate about a pivot 42 and has diametrically opposite ends which are connected to a corresponding sleeve by means of respective articulated linkages 43 and 44. A hydraulic jack 45 is provided in order to move the central rod 41 so that it performs a controlled oscillation.

In the plane which lies transversely to the track (FIG. 6), the beams 40 for the longitudinal connection of the mutually opposite pairs of guides 30–31 are in turn slidingly coupled to cross-members 46 and are subjected to respective pairs of movement jacks 47 which during work move the laterally adjacent guides of each transverse set of tools 30 and 31 towards each other or away from each other, allowing the hammers 25 of said tools to act over the entire transverse extension of the ballast.

In turn, the cross-members 46 comprise telescopically sliding ends 46*a* which are controlled by jacks 47*a* (FIG. 4) that allow to vary the axial distance of the head tools 24.

Figure 7:
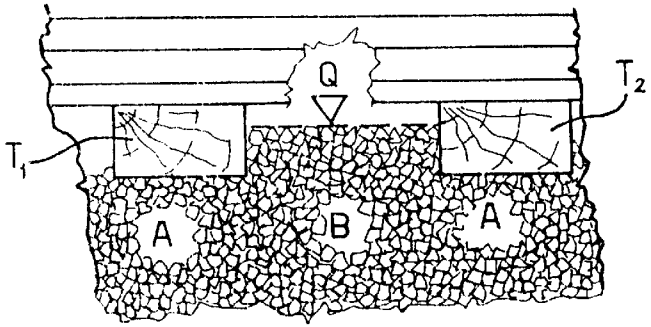
FIG. 7 is a schematic view, similar to FIG. 1, of the distribution of the crushed rock of the ballast after the action of the hammering unit of FIG. 4.

The effect of the action produced by the hammering unit 16 is shown schematically in FIG. 7, which shows that the excess crushed rock initially present in the tamping regions A of the ballast is transferred to the region B of said ballast which lies between two consecutive ties T1–T2, and that a uniform distribution of said crushed rock is achieved, together with a simultaneous compaction of said tamping region A. As a consequence of this transfer, the crushed rock rises, in the region B of the ballast, to a level Q which lies beyond the resting plane of the ties and is therefore subjected, in said region, to subsequent compaction by means of the unit 17.

Figure 1A:
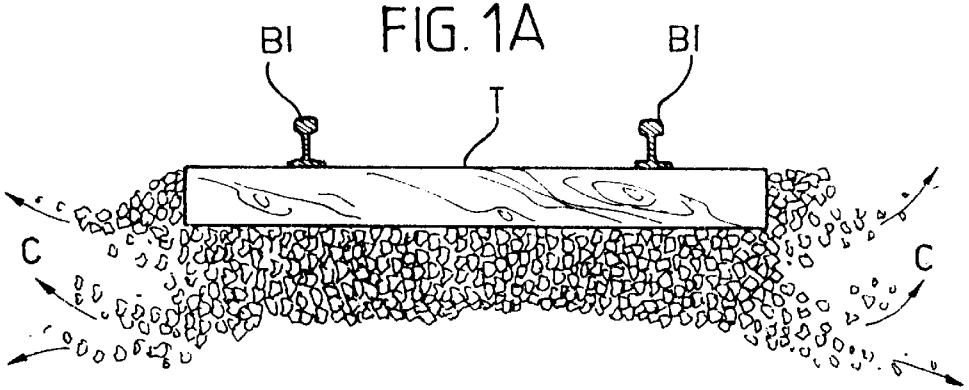
FIGS. 1 and 1*a* are schematic views of the crushed rock settling movement of a conventional non-stabilized railroad ballast when trains pass, taken respectively longitudinally with respect to the track and transversely thereto.
Figure 10:
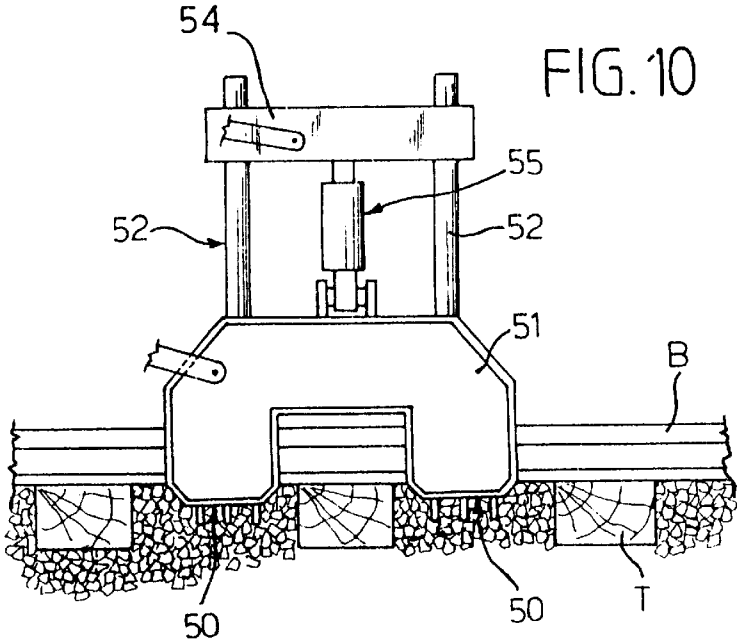
FIG. 10 is a transverse sectional view, taken along the plane X—X of FIG. 9.

For this purpose, the unit 17 is also provided with vibrating hydraulic tools, which are constituted by a plurality of plates 50 which are supported by vertical supports 51 which are shaped like an inverted U and are adapted to be arranged so as to straddle each tie T, as shown in detail in FIG. 10.

Each support 51 is provided with retaining uprights 52 which are slidingly guided in corresponding bushes 53 supported by a supporting cross-member 54, which is rigidly coupled to the vertical movement device described above.

Each support 51 is subjected to the action of a corresponding vibrating hydraulic jack 55, which is interposed between said support and the supporting cross-member 54, and the plurality of jacks 55 is supplied by the same hydraulic circuit that supplies the set of vibrating tools of the hammering unit 16; the extent and rate of vibration of the jacks 55 can therefore be easily varied over a wide range, particularly by merely adjusting the is manual oscillator or the electronic control, if said supply circuit is of the type with electric distribution valves.

Moreover, with the described system provided with vibrating jacks 55 one also obtains a perfectly axial thrust on the plates 50 which cannot be obtained with the eccentric-mass vibrating systems of conventional compacting units.

Preferably, two additional lateral plates 56*a*–56*b* are also arranged at the mutually opposite ends 54*a*–54*b* of the cross-member 54; each one of said plates is directly pivoted to the ends of the stems of corresponding pairs of vibrating jacks 57*a*–57*b* and is adapted to be arranged at an angle in order to compact the corresponding ballast slope. As an alternative, the vibrating jacks 57 can be supported by the cross-member 54 at an angle and their stem can be arranged at right angles to the plane of the respective ballast slope.

Figure 11:
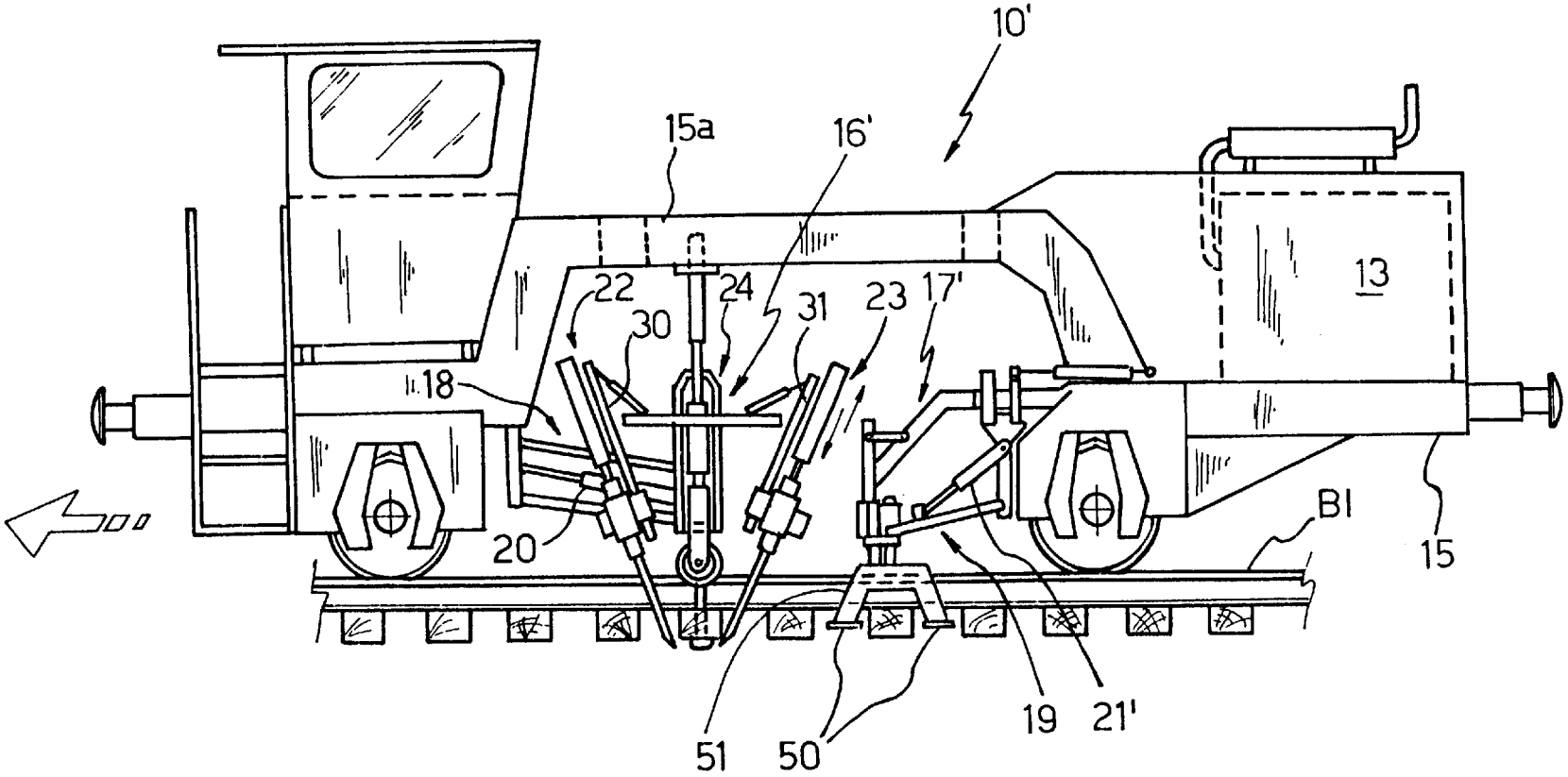
FIGS. 11, 12, and 13 are views, similar to FIGS. 2, 8, and 9 respectively, of a constructive different embodiment of the machine according to the invention.
Figure 12:
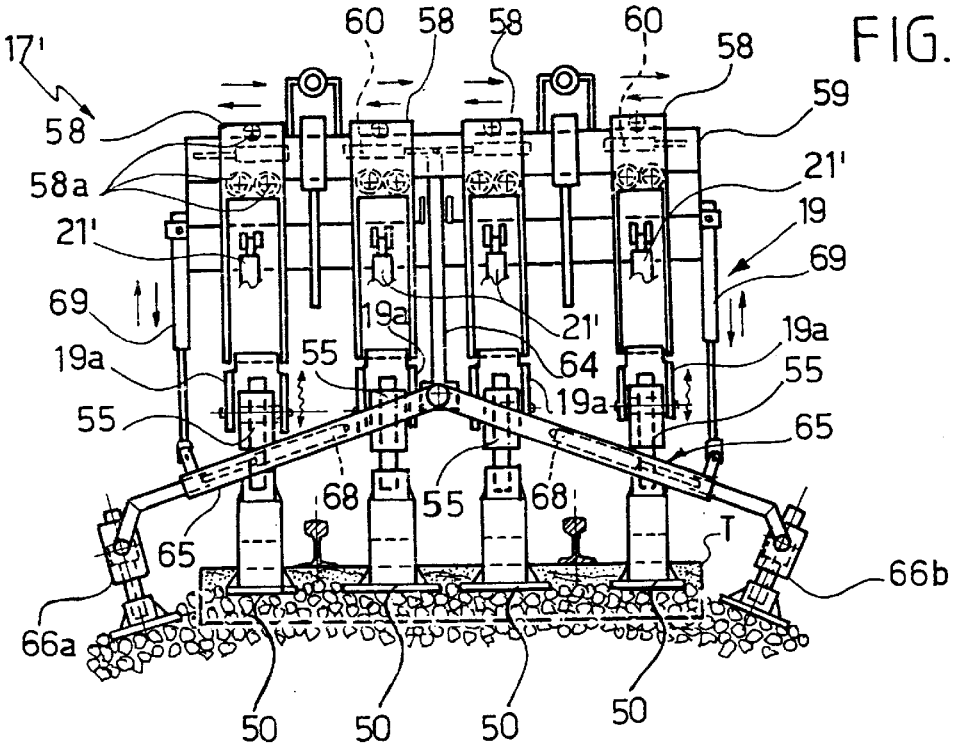
Figure 13:
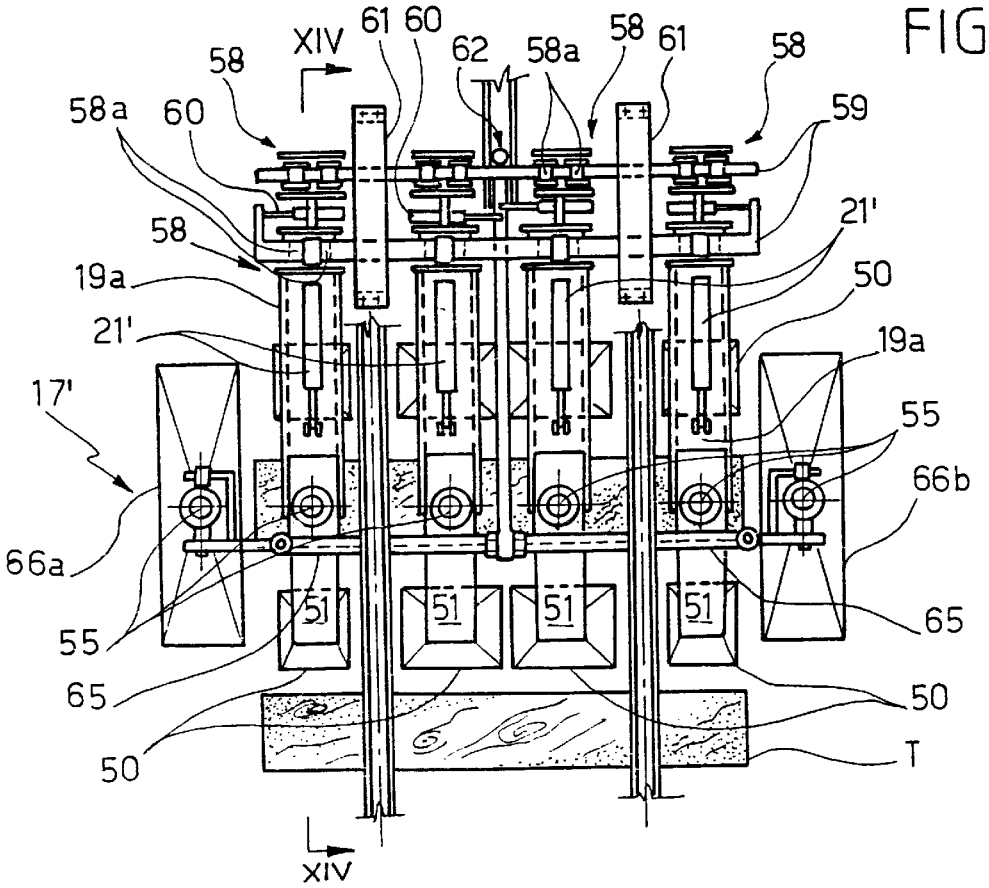
Figure 14:
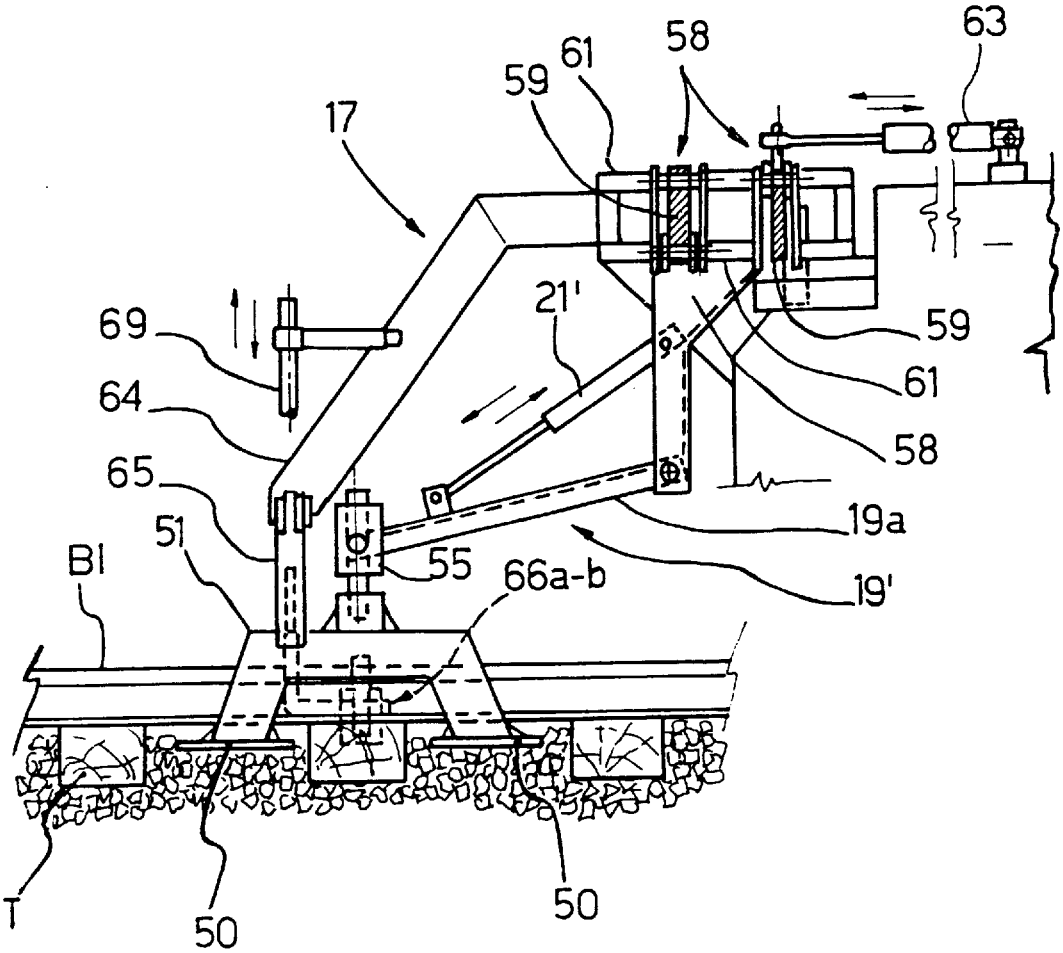
FIG. 14 is a sectional view, taken along the plane XIV—XIV of FIG. 13.

According to the embodiment of FIGS. 11 and 14, the arrangement of the hammering and compacting units 16' and 17' is reversed with respect to the chassis 15 of the car 10', so as to allow easier monitoring of the work of the hammering unit from the cabins of said car, which in this case travels in the opposite direction with respect to the car of FIG. 2. Moreover, according to this embodiment, each U-shaped support 51 of the unit 17' is subjected to the direct action of a corresponding vibrating hydraulic jack 55, which is articulated to the fork-like end of a corresponding arm 19*a* of the supporting structure 19', and each arm is subjected to a respective jack 21' for individual vertical movement.

The ends of the individual arms 19*a* which lie opposite to the ends provided with the jacks 55 are articulated to respective carriages 58 provided with mutually opposite wheels 58*a* and movable on guiding and supporting cross-members 59 in order to adjust their transverse position, the carriages 58 being subjected to individual transverse adjustment jacks 60. The cross-members 59 are in turn supported, so that they can move longitudinally, by pairs of mutually opposite longitudinal members 61, which allow both the longitudinal adjustment of the unit 17' with respect to the chassis 15 and a limited steering of said unit about a contrast pivot 62.

The longitudinal adjustment and the steering of the entire unit are performed by means of a pair of jacks 63 which are actuated simultaneously or respectively in a differentiated manner. On the side lying in front of the arms 19*a*, the structure 19' continues with a subvertical central rigid beam 64, and two telescoping arms 65 are articulated to the lower end of said beam; said arms have, at their respective ends, mutually opposite vibrating jacks 66*a*–66*b* which are directly connected to corresponding vibrating plates 67*a*–67*b* which are arranged at an angle in order to compact the corresponding ballast slope.

The length of the arms 65 can be adjusted through respective hydraulic jacks 68 and their inclination can be adjusted by means of corresponding hydraulic jacks 69 which are arranged vertically.

According to the described second embodiment, in the unit 17', too, each pair of compacting plates 50 can be raised easily and individually through the actuation of the corresponding jack 21' in order to temporarily exclude it from the working cycle according to the different operating requirements.

The hammering unit 16 and the compacting unit 17, arranged one in front of the other, with reference to the motion of the car 10–10' indicated by the respective arrows in FIGS. 2 and 11, are spaced one from the other by an extent which is a multiple of the different spacing pitch of the ties T of the track, so that the compacting unit can act after the hammering unit in order to compact the crushed rock moved by said hammering unit.

Without altering the concept of the invention, the details of execution and the embodiments may of course be altered extensively with respect to what has been described and illustrated by way of non-limitative example without thereby abandoning the scope of the invention.

What is claimed is:

1. A self-propelled machine for stabilizing tracks laid on ties over ballast, the machine comprising a self-propelled truck which comprises a first hammering unit and a second compacting unit, the first hammering unit comprising sets of inclined vibrating hydraulic tools for insertion in the ballast for limiting migration of crushed rock from tamping regions of the ballast below each tie to intermediate ballast regions between two consecutive ties, said sets of inclined vibrating hydraulic tools being mutually oppositely arranged in the first hammering unit such as to be arrangeable to straddle a selected tie, the second unit comprising vibrating plates for compacting the crushed rock placed in a layer above a laying plane of the ties in the intermediate ballast regions and on heads of the ties, the hammering unit comprising at least two of said sets of mutually opposite vibrating tools which are adjustable in a mutual distance extending transversely to the ties for being able to straddle ties of different size and for being able to straddle multiple ties and two of said mutually opposite vibrating tools arranged at the heads of said ties the vibrating tools of the hammering unit being supported by respective sliders which are slidably arranged on inclined guides and are connected to and actuatable by corresponding movement jacks such that said vibrating tools are movable along respective subvertical advancement paths which mutually intersect below each tie in a selectable imaginary point.

2. A machine according to claim 1, wherein said first and second units are supported by a portal-shaped chassis and are mutually spaced by an extent which is a multiple of specific pitches of the ties and are arranged so that during a working motion of the self-propelled truck the first unit precedes the second unit.

3. A machine according to claim 2, wherein said first and second units are supported by said portal-shaped chassis with interposition between the chassis and the units of respective vertical movement devices for selectively arranging said units in a raised transfer position or in a lowered working position.

4. A machine according to claim 3, wherein said movement devices comprise articulated frames selectively configure by means of corresponding movement jacks and mechanically lockable in a raised position.

5. A machine according to claim 1, wherein each said vibrating hydraulic tool comprises a hammer movable in a reciprocating manner by a corresponding double-action hydraulic jack at an adjustable rate, and with an adjustable stroke.

6. A machine according to claim 5, wherein the double-action hydraulic jack of each of said vibrating hydraulic tools is supplied by a hydraulic circuit comprising one of: two-way electric distribution valves energized by an adjustable-frequency oscillator: and a single rotary distributor actuated by an adjustable-speed motor.

7. A machine according to claim 1, further comprising means for varying an inclination of the guides slidably supporting the vibrating tools; means for varying a longitudinal distance between respective pairs of the vibrating tools; and means for varying a mutual transverse axial distance between the tools of each pair.

8. A machine according to claim 7, wherein the guides slidably supporting the pairs of mutually opposite vibrating tools are articulated to respective sleeves and are actuatable by hydraulic jacks for rotating said guides about a respective pivoting point and for rigidly coupling said guides to a respective sleeve with a desired inclination.

9. A machine according to claim 8, wherein the pairs of mutually opposite sleeves for the pivoting of the guides are slidably arranged on respective longitudinal beams and are connected to a kinematic movement system for moving the sleeves mutually closer or further apart by sliding the sleeves simultaneously in opposite directions on said beams.

10. A machine according to claim 9, wherein said kinematic movement system comprises a central rotating rod having diametrically opposite ends which are connected, by means of respective articulated linkages, to a corresponding sleeve, a hydraulic jack being connected to said central rod for moving said central rod by controlled oscillation.

11. A machine according to claim 9, wherein said longitudinal beams are slidingly rigidly coupled to cross-members and are actuatable by hydraulic jacks for varying an axial distance between laterally adjacent guides of each pair of vibrating tools for allowing the hammers of said tools to act on an entire transverse extension of the ballast.

12. A machine according to claim 11, wherein the cross-members have telescoping ends connected to and movable by jacks for varying an axial distance of the pairs of end tools.

13. A self-propelled machine for stabilizing tracks laid on ties over ballast, the machine comprising a self-propelled truck which comprises a first hammering unit and a second compacting unit supported by a chassis, the first hammering unit comprising sets of inclined vibrating hydraulic tools for insertion in the ballast for limiting migration of crushed rock from tamping regions of the ballast below each tie to intermediate ballast regions between two consecutive ties, said sets of inclined vibrating hydraulic tools being mutually oppositely arranged in the first hammering unit such as to be arrangeable to straddle a selected tie, the second unit comprising vibrating plates for compacting the crushed rock placed in a layer above a laying plane of the ties in the intermediate ballast regions and on heads of the ties, the second compaction unit comprising a plurality of vibrating toothed plates supported by supports which are shaped like an inverted U so as to be able to straddle each tie of the track.

14. A machine according to claim 13, wherein each said support is provided with uprights which are slidingly guided in corresponding bushes supported by a supporting cross-member which is rigidly coupled to a vertical movement device interconnected between said chassis and said second unit.

15. A machine according to claim 14, wherein each said support is connected to and actuatable by a respective vibrating hydraulic jack, which is interposed between said supporting cross-member and said support, and wherein the plurality of jacks acting on said supports have operating rates and strokes adjustable by a distribution circuit connected to the vibrating tools of the hammering unit.

16. A machine according to claim 13, wherein said second compaction unit comprises additional head plates, each of said additional head plates being pivoted directly to an end of a stem of a corresponding vibrating head jack and being arrangeable at an angle for compacting a corresponding ballast slope.

17. A machine according to claim 16, wherein each of the additional head plates is rigidly supported by a respective head jack stem, and wherein said head jacks are inclined with respect to a normal of a plane of the corresponding ballast slope to be compacted.

18. A machine according to claim 1, wherein the hammering unit is arranged adjacent to a control cabin of the self-propelled truck, which is movable in a working direction in which the hammering unit precedes the compacting unit.

19. A self-propelled machine for stabilizing tracks laid on ties over ballast, the machine comprising a self-propelled truck which comprises a first hammering unit and a second compacting unit supporting a chassis, the first hammering unit comprising sets of inclined vibrating hydraulic tools for insertion in the ballast for limiting migration of crushed rock from tamping regions of the ballast below each tie to intermediate ballast regions between two consecutive ties, said sets of inclined vibrating hydraulic tools being mutually oppositely arranged in the first hammering unit such as to be arrangeable to straddle a selected tie, the second unit comprising vibrating plates for compacting the crushed rock placed in a layer above a laying plane of the ties in the intermediate ballast regions and on heads of the ties, the compacting unit comprising compacting plates which are supported by corresponding supports shaped like an inverted U each said support being directly connected to and actuatable by a corresponding vibrating jack which is articulated to a fork-like end of a corresponding movable arm which is connected to and actuatable by a further jack for vertical movement.

20. A machine according to claim 19, wherein each arm provided with the vibrating jack at one end is articulated, at an opposite end, to a respective carriage which is provided with mutually opposite wheels and which is movable, for adjusting a transverse position of each arm, along a guiding and supporting cross-member, said carriage being actuated by an individual corresponding transverse movement jack.

21. A machine according to claim 20, wherein the guiding and supporting cross-member is supported for longitudinal movement by a pair of mutually opposite longitudinal members for both a longitudinal adjustment of the compacting unit and a limited steering of said compacting unit with respect to the chassis and wherein said longitudinal adjustment and steering are performed by means of two jacks connected to the carriage, and said two jacks are actuated in one of a simultaneous manner and a differentiated manner.

22. A machine according to claim 20, wherein the cross-member comprises a subvertical central rigid beam, two telescoping arms being articulated to a lower end of said rigid beam, said telescoping arms having, at respective ends, mutually opposite ones of said vibrating jacks which are directly connected to corresponding ones of said vibrating plates which are arranged at an angle for compacting a corresponding ballast slope.

23. A machine according to claim 22, further comprising respective pairs of additional hydraulic jacks for adjusting a length and inclination of the telescoping arms.

* * * * *